US006413484B1

(12) United States Patent
Koch

(10) Patent No.: US 6,413,484 B1
(45) Date of Patent: Jul. 2, 2002

(54) CATALYTIC OXIDATION OF VAPOR EMISSIONS DISCHARGED DURING VEHICLE REFUELING

(75) Inventor: Wolfgang H. Koch, Batavia, IL (US)

(73) Assignee: Tokheim Corporation, Fort Wayne, IN (US)

( * ) Notice: Subject to any disclaimer, the term of this patent is extended or adjusted under 35 U.S.C. 154(b) by 0 days.

(21) Appl. No.: 09/310,048

(22) Filed: May 11, 1999

(51) Int. Cl.[7] ..... B01J 8/00; B01D 53/70; F23J 15/00

(52) U.S. Cl. ..... 423/245.3; 95/14; 95/146; 96/112; 96/115; 431/5; 431/12

(58) Field of Search ..... 423/245.3; 95/14, 95/146, 25; 96/112, 115; 431/5, 12

(56) References Cited

U.S. PATENT DOCUMENTS 3,581,782 A 6/1971 Onufer
3,902,874 A * 9/1975 McAndrew ..... 95/146
3,918,932 A 11/1975 Lee et al.
3,999,936 A 12/1976 Hasselmann
5,484,000 A 1/1996 Hasselmann
5,513,680 A 5/1996 Hilliard, Jr. et al.

* cited by examiner

*Primary Examiner*—Steven P. Griffin
*Assistant Examiner*—Maribel Medina
(74) *Attorney, Agent, or Firm*—Randall J. Knuth

(57) ABSTRACT

A combustion system includes a catalytic oxidizer for oxidizing a mixture of air and fuel vapor. The amount of air provided for mixing with the fuel vapors is determined in accordance with the temperature of the oxidation reaction as measured by a temperature sensor. Controlling the dilution level in this manner provides an efficient vent processing design. The system is used to process vapor emissions emanating from a vehicle fuel tank during refueling.

26 Claims, 2 Drawing Sheets

CATALYTIC OXIDATION OF VAPOR EMISSIONS DISCHARGED DURING VEHICLE REFUELING

BACKGROUND OF THE INVENTION

1. Field of the Invention

The present invention generally relates to combustion systems, and, more particularly, to a method and apparatus for processing effluent vapors using catalytic oxidation.

2. Description of the Related Art

The regulation of hazardous air pollutants has become a prominent feature of governmental efforts designed to remedy the costly and adverse consequences arising from the industrial release of volatile organic compounds by an array of manufacturing activities and facilities such as wastewater treatment operations, storage vessels, process vents, and transfer operations. Industry has responded by developing a variety of combustion technologies aimed at the destruction of the hydrocarbon effluent at the service station vent. The combustion devices were proposed as an alternative to existing equipment that detected and isolated fugitive vapor emissions for storage but did not eliminate the hydrocarbon vapors. Current detection equipment includes sensor units, for example, that are employed to sense the presence of hydrocarbon vent emissions and facilitate their collection and subsequent disposal.

Thermal combustion is an example of one such combustion technology utilized by industry. However, this combustion process has several drawbacks. For example, thermal oxidation requires the combustion process to take place in a chamber at significantly elevated temperatures and for residence times that are sometimes difficult to sustain, particularly at high temperatures. Additionally, supplementary fuel is frequently required to initiate or sustain thermal combustion reactions that operate on hydrocarbon streams with low fuel content. This demand for supplementary fuel will only increase with the growing use of ORVR cars whose operation will result in progressively leaner hydrocarbon vent emissions.

What is therefore needed is a combustion technology that is amenable to destroying vapor effluents characterized by lean fuel concentrations. The system should also be capable of providing a measure of selectable control over the dilution level, and be compatible with industry-wide hazardous disposal guidelines.

SUMMARY OF THE INVENTION

The invention comprises, in one form thereof, a method and apparatus for oxidizing a mixture of air and fuel vapor. The amount of air provided for mixing with the fuel vapors is determined in accordance with the temperature of the oxidation reaction as measured by a temperature sensor. Controlling the dilution level in this manner provides an efficient vent processing design. The system is particularly used to process vapor emissions emanating from a vehicle fuel tank during refueling.

The invention comprises, in another form thereof, a combustion system for processing vapor effluents from a fuel receiving tank. A vapor collection means, which is disposed in vapor communicating relationship with respect to the storage tank, is provided in the combustion system for controllably collecting vapor effluents from the fuel receiving tank. The combustion system further provides an oxidation processing means for operatively oxidizing a vapor composition including hydrocarbon and oxygen; and sensor means for sensing a temperature associated with the oxidizing activity of the oxidation processing means. A vapor dilution means, which is responsive to the temperature sensed by the sensor means, is provided for controllably diluting the collected vapor effluents as a function of the sensed temperature to form a mixture including air and vapor effluents. A vapor transfer means is further provided for transferring the air-vapor mixture from the vapor dilution means to the oxidation processing means for oxidation therein.

The oxidation processing means further includes an oxidation catalyst. The sensor means further includes means for determining the temperature of the oxidation catalyst. The combustion system further includes, in another form thereof, a combustion chamber containing the oxidation catalyst, wherein the sensor means further includes means for determining the temperature within the combustion chamber.

The combustion system is operationally characterized, in another form thereof, wherein the level of vapor effluent dilution effectuated by the vapor dilution means is effective in controllably regulating the oxidation activity of the oxidation processing means such that the oxidation activity is controllably maintained within a selectable operating range.

The vapor dilution means comprises, in one form thereof, a dilution level determining means for determining an air concentration level for the vapor mixture as a function of the sensed temperature provided by the sensor means; and air supply means for supplying a controllable flow of air. A mixing means is provided for controllably combining, in accordance with the air concentration level determined by the dilution level determining means, a flow of the collected vapor effluents and a flow of air from the air supply means.

The invention comprises, in another form thereof, a combustion system for processing vapor emissions from a fuel receiving tank, wherein the combustion system is operatively associated with a fuel dispensing means for delivering fuel into the fuel receiving tank. The combustion system includes a vapor collection means for controllably collecting vapor emissions from the fuel receiving tank; a catalytic oxidation means for operatively catalytically oxidizing a vapor composition including a fuel component and an air component; and a temperature determining means for determining an oxidation temperature associated with the catalytic oxidizing activity of the catalytic oxidation means. A vapor mixing means is provided for controllably mixing the vapor emissions collected by the vapor collection means with a controllable amount of air, as determined by the oxidation temperature provided by the temperature determining means, to form a vapor mixture thereof having a selectable dilution level. A vapor transfer means is further provided for transferring the vapor mixture from the vapor mixing means to the catalytic oxidation means for catalytic oxidation therein.

The catalytic oxidation means includes an oxidation catalyst operative to support an oxidation reaction involving hydrocarbon. The temperature determining means includes a sensor means for sensing an operating temperature of the catalytic oxidation means. The vapor mixing means comprises, in one form thereof, a dilution level determining means for determining an air concentration level for the vapor mixture as a function of the oxidation temperature determined by the temperature determining means. The vapor mixing means further includes an air supply means for supplying a controllable flow of air. A combining means is further provided for controllably combining, in accordance with the air concentration level determined by the dilution level determining means, a flow of the collected vapor emissions and a flow of air from the air supply means.

The invention comprises, in yet another form thereof, a combustion system for processing fuel vapors contained within a fuel storage tank. The system is operatively associated with a fueling apparatus including fuel dispensing means for dispensing fuel from the storage tank to a vehicle fuel container; fuel recovery means for recovering vapor effluents from the vehicle fuel container that develop during refueling activity; and means for transferring the recovered vapor effluents, at least in part, to the storage tank.

The combustion system includes a venting means for controllably venting fuel vapors from the storage tank; an oxidation processing means for operatively oxidizing a vapor composition including hydrocarbon and oxygen; and a sensor means for sensing a temperature associated with the oxidizing activity of the oxidation processing means. A vapor dilution means, which is responsive to the temperature sensed by the sensor means, is provided for controllably diluting the vented vapor effluents as a function of the sensed temperature to form a mixture including air and vapor effluents. A vapor transfer means is further provided for transferring the air-vapor mixture from the vapor dilution means to the oxidation processing means for oxidation therein.

The oxidation processing means further includes an oxidation catalyst. The sensor means includes a means for determining the temperature of the oxidation catalyst. The combustion system includes, in another form thereof, a combustion chamber containing the oxidation catalyst. The sensor means includes, in another form thereof, a means for determining the temperature within the combustion chamber.

The invention comprises, in yet another form thereof, a method of processing vapor effluents from a fuel receiving tank. The processing method involves collecting the vapor effluents; providing an oxidation catalyst that is operative in oxidizing fuel vapors; and sensing an operating temperature of the oxidation catalyst. The collected vapor effluents are controllably diluted with an amount of air according to the sensed operating temperature of the oxidation catalyst to form a vapor mixture thereof having a selectable air concentration. The vapor mixture formed by the dilution activity is transferred to the oxidation catalyst for oxidation therein.

One advantage of the present invention is that the combustion system affords a degree of selective control over the appropriate level of dilution of the vapor effluent stream on the basis of an easily acquired measurement value (i.e., oxidation reaction temperature).

Another advantage of the present invention is that the catalytic oxidation reaction of the combustion system is capable of supporting lean mixtures of fuel vapor and air.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
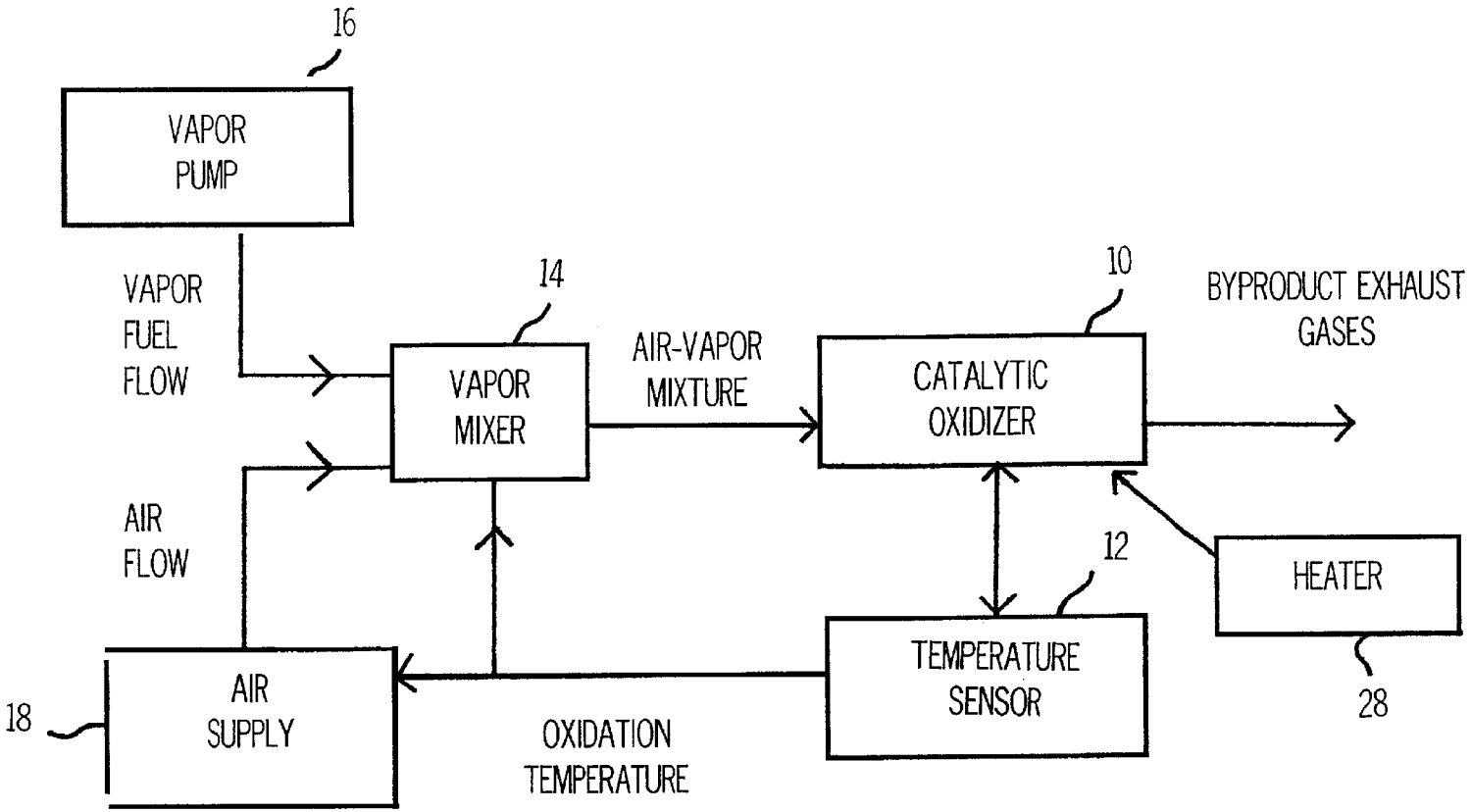
FIG. 1 is a block diagram illustration of a combustion system for processing vapor effluents according to one embodiment of the present invention.

FIG. 1 shows, in illustrative form, a combustion system according to one embodiment of the present invention for processing vapor fuel effluents using a catalytic oxidation reaction that converts diluted vapor fuel components into environmentally acceptable exhaust gases. In accordance with the present invention, the extent of dilution of the vapor fuel components is controlled by the temperature of the oxidation reaction as measured by a temperature sensor. As will be discussed hereinafter in regard to FIG. 2, the combustion system is preferably integrated with a fuel recovery system particularly useful in applications involving vehicle refueling operations in which the combustion system will process the vapor emissions that are discharged while fuel is being dispensed into the vehicle.

Referring to FIG. 1, the combustion system includes a catalytic oxidizer 10 operatively supporting an oxidation reaction that converts an inflowing vapor stream comprising a mixture of air and hydrocarbon vapors into an outflowing vapor stream comprising a mixture of carbon dioxide and water. A temperature sensor 12 is provided to detect the temperature of the oxidation reaction occurring in catalytic oxidizer 10. The oxidation temperature thereby provided is used to control the extent of dilution of the fuel vapors. For this purpose, a vapor mixer 14 is provided to controllably combine an air flow and a vapor fuel flow to form an air-vapor mixture that is delivered as the inflowing vapor stream to catalytic oxidizer 10. The vapor fuel flow is provided by a vapor pump 16 that collects vapor emissions emanating from a fuel vapor source. In applications where vapor pump 16 forms part of a fuel recovery system, the fuel vapor flow corresponds to the hydrocarbon effluents discharged from the vehicle tank during dispensing of the liquid fuel therein. The air flow is generated by an air supply 18 (or any other equivalent means). The dilution of the vapor fuel flow refers to the concentration of air components relative to hydrocarbon in the resultant air-vapor mixture. The degree of dilution (i.e., the amount of air mixed with the hydrocarbon vapor by vapor mixer 14) may be controlled either by direct adjustment of air supply 18 or by regulation of the air flow in vapor mixer 14 once it arrives there to be mixed. In either case, the amount of dilution will be determined as a function of the oxidation temperature provided by temperature sensor 12.

Catalytic oxidizer 10 employs an oxidation catalyst structure that is designed to selectively promote the combustion reaction involving the conversion of diluted hydrocarbon vapor (i.e., a mixture of hydrocarbon and oxygen) into gaseous water vapor and carbon dioxide. The reaction may be considered exothermic since the conversion process involves the release of energy in the form of heat. The catalytic oxidation of hydrocarbon is believed to proceed via dissociative chemisorption of the hydrocarbon molecule followed by reaction of the abstracted hydrogen with co-adsorbed oxygen. The combustion reaction occurs on the catalyst surface, and the combustion byproducts are then desorbed into the gas phase. The catalyst material is preferably platinum group metal, although any other suitable substance may be used. A general discussion of catalytic oxidation is disclosed by W. Chu and H. Windawi in "Control VOCs via Catalytic Oxidation", Chemical Engineering Progress, pp. 37–43 (March 1996), incorporated herein by reference.

The activity of oxidation catalysts can be described with a light-off curve, which is a generally S-shaped plot of conversion efficiency versus temperature. The light-off curve is divided into three distinct regions characterized by elevated efficiency with increasing temperature: kinetically limited, light-off, and mass-transfer-limited. At low temperatures, the reaction is kinetically limited, and any oxidation or conversion that occurs is dependent on interactions of the hydrocarbon and oxygen molecules that take place on the catalyst surface. As the temperature increases, the reaction rate increases sharply as the heat of reaction starts to contribute more to the reaction itself. This area on the curve is known as the light-off region and is characterized by a very steep rise in conversion efficiency over a small change in temperature. When light-off has been achieved, the reaction enters the mass-transfer-limited region, where the reaction is immediate and is only limited by the reactants' ability to arrive at the catalyst sites. These regions define the characteristic operating temperature range of the catalytic oxidizer and, in particular, describe the relationship between conversion efficiency and oxidation temperature. Operation below the temperature which marks the beginning or lowest temperature for the light-off region of the light-off curve is possible but is not optimum. With this in mind, heating means 28 keeps the catalyst surface at a minimum temperature which corresponds to the lowest temperature which is associated with the light-off region of the light-off curve. this heating means can be, for example, an electrical heater 28. The procedure for determining what is the most appropriate dilution level to establish in the vapor-air mixture provided to oxidizer 10 is a parameter employed by the present invention to indicate the particular mode of oxidation activity. As will be discussed hereinafter, the light-off curve becomes a useful analytic tool in rendering an accurate interpretation of the measured oxidation temperature by graphically providing an indication of the oxidizer operating mode as a function of the oxidation temperature. The indicated mode can then be utilized to facilitate a determination of the proper dilution level to be established.

Temperature sensor 12 may be any measurement apparatus known to those skilled in the art for determining the temperature associated with the oxidation reaction in catalytic oxidizer 10. The measurement value, in particular, may be representative of the temperature of the catalyst structure itself or the temperature of the ambient environment within the reaction chamber containing the catalyst structure. For this purpose, sensors may be provided that are disposed in temperature-sensing relationship to the catalyst structure and the ambient environment.

In one aspect of the present invention, means are provided to cross-reference the measured oxidation temperature with light-off data representing the particular light-off curve that is characteristic of the oxidation catalyst being used. This procedure permits one to ascertain the current oxidation operating mode (i.e., kinetically limited, light-off, or mass-transfer-limited) and the corresponding conversion efficiency. A representative analysis of the variations in dilution level as a function of measured oxidation temperature is discussed below, focusing first on the operation of the combustion system at the limits of the temperature range.

At the upper temperature levels where the oxidation activity is in the mass-transfer-limited region, and possibly approaching a thermally destructive threshold, it may be advisable to increase the dilution level in order to stabilize and/or reduce the operating temperature. Conversely, at the lower temperature levels where the conversion efficiency may be inadequate due to improper stoichiometric balances or fuel depletion, it may be advisable to enrich the air-vapor mixture by reducing the air concentration. This enrichment strategy will be particularly useful in connection with ORVR cars whose operation will result in progressively leaner hydrocarbon vent emissions, requiring low temperature manipulation of the oxidation reaction in order to urge its activity toward a higher conversion efficiencies, such as by the temperature dependent dilution control of the present invention. At all other intermediate oxidation temperatures, the dilution level is preferably adjusted on a continuous basis in response to the measured oxidation temperature to provide a controllably regulated and stabilized operating temperature range. As a result, the oxidation activity can be carefully varied by periodically or, in a preferred configuration, continuously monitoring the oxidation temperature and making the appropriate adjustments based on the measured temperature and the selected conversion efficiency desired for catalytic oxidizer 10. What is thereby provided is an efficient combustion system.

The combustion system of the present invention is operative to monitor the temperature of the oxidation reaction and to adjust the dilution level of the vapor effluents in accordance with the detected oxidation temperature. In a preferred form of the combustion system, the temperature monitoring and dilution adjustment are performed on a continuous basis to provide precise and real-time regulation of the oxidizing activity and to thereby avoid excessive and unwanted fluctuations in the operation of oxidizer 10. One configuration to implement such continuous regulation of the oxidizing activity would incorporate a control function and arrange catalytic oxidizer 10, temperature sensor 12, and vapor mixer 14 (as used in conjunction with air supply 18) so as to form a feedback configuration designed to control the level of dilution within the air-vapor mixture provided to catalytic oxidizer 10. A controller (not shown) is preferably provided for this purpose to make a specific determination of the dilution level based upon the oxidation reaction temperature measured by sensor 12, and to initiate the indicated adjustment, if any, for effectuating the change in dilution level. For example, if air supply 18 is furnished with valves capable of producing a selectively controllable air flow rate, the controller could appropriately activate these valves to vary the air flow and hence the dilution level. Alternatively, any type of activatable mechanism may be provided in vapor mixer 14 to allow regulation of the incoming air flow. Vapor pump 16 may be regulated by the controller to permit a controlled rate of vapor fuel flow. The controller may be programmed to make such adjustments to the dilution level in accordance with a selectable time interval or cycle.

Regulation of the dilution level is a dynamic operation not limited to certain extremities of the operating range or to predetermined alarm thresholds; rather, the dilution level may be regulated to effect a change in the oxidation activity across the entire operating temperature range. The present invention preferably incudes any equipment or components suitable for rendering the combustion system fully automatic, provided that user input controls are furnished to allow user selection of the dilution level. The control function preferably incorporated data representing the catalyst light-off curve so that an automatic determination can be made of the operating mode and the conversion efficiency based on the measured temperature. This determination is then used in assisting with the selection the appropriate level of dilution.

Figure 2:
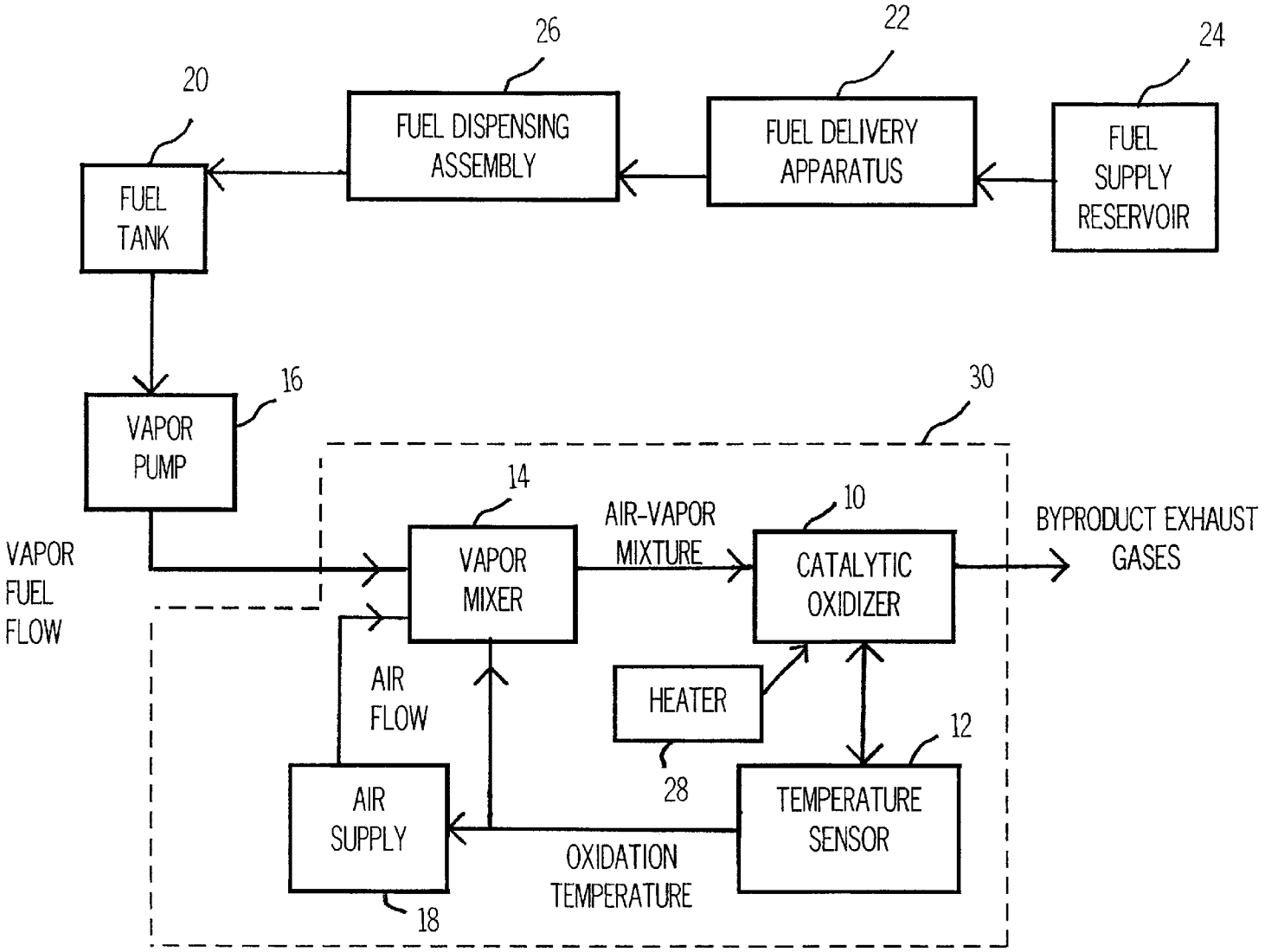
FIG. 2 is a block diagram illustration of a combustion system for processing emissions emanating from a vehicle fuel tank during refueling activity, in accordance with a preferred embodiment of the present invention.

Referring to FIG. 2, there is shown a combustion system according to a preferred embodiment of the present invention for processing vapor effluents discharged from a vehicle fuel tank during refueling. The subsystems of the combustion system referenced generally at 30 form a feedback network preferably constructed as an integrated unit, and operate identically to the arrangement of similarly referenced components in FIG. 1.

In the illustrated embodiment, the vapor fuel flow provided to vapor mixer 14 is obtained from vapor pump 16 and corresponds to hydrocarbon vapor emissions emanating from fuel tank 20. A fuel delivery system is shown including a fuel delivery apparatus 22 coupled to fuel supply reservoir 24 and operative to pump liquid fuel therefrom. A fuel dispensing assembly 26 is adapted to dispense the pumped liquid fuel from fuel delivery apparatus 22 into an orifice of fuel tank 20. In vehicle applications, the fuel dispensing assembly 26 will preferably be configured in the form of a nozzle member having a dispensing portion that is insertable, at least in part, into a filler neck defining the refueling inlet passageway of tank 20. The illustrated fuel delivery system is well known to those skilled in the art and is generally representative of any arrangement capable of delivering fuel to tank 20.

Volatilized hydrocarbon vapors contained within fuel tank 20 are displaced by the liquid fuel being dispensed therein, causing the displaced vapors to be forced out of tank 20 through the refueling orifice. These fugitive vapor emissions are collected by the vacuum action developed by vapor pump 16 and constitute the vapor fuel flow provided to the combustion system.

The combustion system of the present invention has broad applicability to other facilities requiring volatile organic compound (VOC) processing. For example, it is a common industrial practice to route collected fugitive vapor emissions back to the original liquid fuel containment unit such as fuel supply reservoir 24 in FIG. 2. The combustion system disclosed herein may be used to process the fuel vapors being stored in the containment unit. In such an embodiment, a means is provided for venting the stored vapors from the containment unit and transferring the vented vapors to the combustion system as the vapor fuel flow applied to vapor mixer 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A combustion system for processing vapor effluents from a fuel receiving tank, comprising:

vapor collection means, disposed in vapor communicating relationship with respect to said fuel receiving tank, for controllably collecting vapor effluents from said fuel receiving tank;

oxidation processing means for operatively oxidizing a vapor composition including hydrocarbon and oxygen;

sensor means for sensing a temperature associated with the oxidizing activity of said oxidation processing means;

vapor dilution means directly connected to said vapor collection means, responsive to the temperature sensed by said sensor means, for controllably diluting the collected vapor effluents as a function of said sensed temperature to form a mixture including air and vapor effluents; and vapor transfer means for transferring the air-vapor mixture provided by said vapor dilution means directly to said oxidation processing means for oxidation therein.

2. The combustion system as recited in claim 1, wherein said oxidation processing means further comprises:

an oxidation catalyst.

3. The combustion system as recited in claim 2, wherein said sensor means further comprises:

means for determining the temperature of said oxidation catalyst.

4. The combustion system as recited in claim 2, further comprises:

a combustion chamber containing said oxidation catalyst.

5. The combustion system as recited in claim 4, wherein said sensor means further comprises:

means for determining the temperature within said combustion chamber.

6. The combustion system as recited in claim 1, wherein the level of vapor effluent dilution effectuated by said vapor dilution means is effective in controllably regulating the oxidation activity of said oxidation processing means such that said oxidation activity is controllably maintained within a selectable operating range.

7. The combustion system as recited in claim 6, wherein the controllable regulation of the oxidation activity of said oxidation processing means attributable to said vapor effluent dilution includes selectively shifting said oxidation activity within and between a light-off operating mode and a mass-transfer-limited operating mode characteristic of said oxidation processing means.

8. The combustion system as recited in claim 1, wherein said vapor dilution means comprises:

dilution level determining means for determining an air concentration level for said vapor mixture as a function of the sensed temperature provided by said sensor means;

air supply means for supplying a controllable flow of air; and mixing means for controllably combining, in accordance with the air concentration level determined by said dilution level determining means, a flow of said collected vapor effluents and a flow of air provided by said air supply means.

9. The combustion system as recited in claim 8, further comprises:

vapor flow means, operatively coupled to said vapor collection means, for developing a flow stream of vapor effluents collected by said vapor collection means.

10. The combustion system as recited in claim 1, wherein said vapor collection means comprises:

a vapor pump.

11. The combustion system as recited in claim 1, where in operation of said sensor means and said vapor dilution means is adapted so as to provide a substantially continuous sensing of the temperature associated with the oxidizing activity and controllable dilution of the collected vapor effluents.

12. A combustion system for processing vapor emissions from a fuel receiving tank, said combustion system being operatively associated with a fuel dispensing means for delivering fuel into said fuel receiving tank, comprising:

vapor collection means for controllably collecting vapor emissions from said fuel receiving tank;

catalytic oxidation means for operatively catalytically oxidizing a vapor composition including a fuel component and an air component;

temperature determining means for determining an oxidation temperature associated with the catalytic oxidizing activity of said catalytic oxidation means;

heating means for maintaining the catalytic oxidation means at a temperature corresponding to the lowest temperature in the light-off region of the light-off curve;

vapor mixing means directly connected to said vapor collection means, for controllably mixing the vapor emissions collected by said vapor collection means with a controllable amount of air as determined by the oxidation temperature provided by said temperature determining means directly to form a vapor mixture thereof having a selectable dilution level; and vapor transfer means for transferring the vapor mixture provided by said vapor mixing means directly to said catalytic oxidation means for catalytic oxidation therein.

13. The combustion system as recited in claim 12, wherein said catalytic oxidation means comprises:

an oxidation catalyst operative to support an oxidation reaction involving hydrocarbon.

14. The combustion system as recited in claim 12, wherein said temperature determining means comprises:

sensor means for sensing an operating temperature of said catalytic oxidation means.

15. The combustion system as recited in claim 12, wherein said heating means comprises:

an electrical heater.

16. The combustion system as recited in claim 12, further comprises:

dilution control means, responsive to the oxidation temperature provided by said temperature determining means, for determining a dilution level effected by the mixing activity within said vapor mixing means that is sufficient to create a selectable oxidation activity within said catalytic oxidation means; and means for applying the dilution level determined by said dilution control means to said vapor mixing means as a control signal to effect control of said vapor mixing means in response thereto.

17. The combustion system as recited in claim 16, wherein the selected oxidation activity within said catalytic oxidation means attributable to the dilution level determined by said dilution control means is characterized by a selected operating temperature range.

18. The combustion system as recited in claim 12, wherein said vapor mixing means comprises:

dilution level determining means for determining an air concentration level for said vapor mixture as a function of the oxidation temperature determined by said temperature determining means;

air supply means for supplying a controllable flow of air; and combining means for controllably combining, in accordance with the air concentration level determined by said dilution level determining means, a flow of said collected vapor emissions and a flow of air provided by said air supply means.

19. The combustion system as recited in claim 12, wherein operation of said temperature determining means and said vapor mixing means is adapted so as to provide a substantially continuous sensing of the temperature associated with the catalytic oxidizing activity and controllable mixing of the collected vapor emissions.

20. A combustion system for processing fuel vapors contained within a fuel storage tank, said system being operatively associated with a fueling apparatus including fuel dispensing means for dispensing fuel from said storage tank to a vehicle fuel container; fuel recovery means for recovering vapor effluents from said vehicle fuel container that develop during refueling activity; and means for transferring said recovered vapor effluents, at least in part, to said storage tank, said combustion system comprising:

venting means for controllably venting fuel vapors from said storage tank;

oxidation processing means for operatively oxidizing a vapor composition including hydrocarbon and oxygen;

sensor means for sensing a temperature associated with the oxidizing activity of said oxidation processing means;

vapor dilution means directly connected to said venting means, responsive to the temperature sensed by said sensor means, for controllably diluting the vented vapor effluents as a function of said sensed temperature to form a mixture including air and vapor effluents; and vapor transfer means for transferring the air-vapor mixture provided by said vapor dilution means directly to said oxidation processing means for oxidation therein.

21. The combustion system as recited in claim 20, wherein said oxidation processing means further comprises:

an oxidation catalyst.

22. The combustion system as recited in claim 21, wherein said sensor means further comprises:

means for determining the temperature of said oxidation catalyst.

23. The combustion system as recited in claim 21, further comprises:

a combustion chamber containing said oxidation catalyst.

24. The combustion system as recited in claim 23, wherein said sensor means further comprises:

means for determining the temperature within said combustion chamber.

25. The combustion system as recited in claim 20, wherein operation of said sensor means and said vapor dilution means is adapted so as to provide a substantially continuous sensing of the temperature associated with the oxidizing activity and controllable dilution of the vented vapor effluents.

26. A method of processing fuel vapor effluents from a fuel receiving tank, comprising the steps of:

collecting said fuel vapor effluents;

providing an oxidation catalyst operative in oxidizing fuel vapors;

sensing an operating temperature of said oxidation catalyst;

controllably diluting the collected fuel vapor effluents with an amount of air according to the sensed operating temperature of said oxidation catalyst to form a vapor mixture thereof having a selectable air concentration, said diluting of the collected fuel vapor effluents is immediately following said collecting of said fuel vapor effluents; and transferring the vapor mixture formed by said dilution step directly to said oxidation catalyst for oxidation therein.

* * * * *